US008227675B2

(12) United States Patent
Koelzer

(10) Patent No.: US 8,227,675 B2
(45) Date of Patent: Jul. 24, 2012

(54) PICK AND METHOD FOR ACHIEVING ENHANCED SOUND FROM A STRUMMED MUSICAL INSTRUMENT

(76) Inventor: Daniel Koelzer, Grosse Pointe, MI (US)

( * ) Notice: Subject to any disclaimer, the term of this patent is extended or adjusted under 35 U.S.C. 154(b) by 0 days.

(21) Appl. No.: 12/883,349

(22) Filed: Sep. 16, 2010

(65) Prior Publication Data

US 2011/0067550 A1 Mar. 24, 2011

Related U.S. Application Data

(60) Provisional application No. 61/242,840, filed on Sep. 16, 2009.

(51) Int. Cl.
*G10D 3/16* (2006.01)

(52) U.S. Cl. ..... 84/320
(58) Field of Classification Search ..... 84/320–322
See application file for complete search history.

(56) References Cited

U.S. PATENT DOCUMENTS 7,825,315 B1 * 11/2010 King ..... 84/322
2005/0223872 A1 * 10/2005 Greenwald ..... 84/322
* cited by examiner

*Primary Examiner* — Kimberly Lockett
(74) *Attorney, Agent, or Firm* — John R. Benefiel

(57) ABSTRACT

A pick and method for obtaining a bright sound from a strummed instrument and in particular a guitar, the pick having a plurality of points about its rounded perimeter arranged in a uniform series to form a serrated edge, which points are sized and spaced so that a plurality of points substantially simultaneously engage a string when strummed, producing a bright chorus sound.

10 Claims, 1 Drawing Sheet

PICK AND METHOD FOR ACHIEVING ENHANCED SOUND FROM A STRUMMED MUSICAL INSTRUMENT

CROSS REFERENCE TO RELATED APPLICATIONS

This application claims the benefit of U.S. provisional application No. 61/242,840 filed on Sep. 16, 2009, which is hereby incorporated by reference.

BACKGROUND OF THE INVENTION

This invention concerns a pick for achieving a bright sound from a strummed musical instrument and in particular from a guitar.

Picks have traditionally been of simple geometric shapes, typically generally triangular pieces of plastic with rounded points to enable particular strings to be strummed or plucked while playing. Some shapes require the pick to be held in the fingers in a certain orientation while playing the instrument, necessitating that the player holds the pick in a proper way.

A particular pick shape or stiffness might facilitate playing the instrument but generally picks do not themselves contribute to the quality of sound produced while playing a strummed instrument.

It is an object of the present invention to provide a pick which creates an enhanced sound when strings of a musical instrument and in particular a guitar, are strummed and which pick is not required be held in the fingers in a particular orientation when playing the instrument.

SUMMARY OF THE INVENTION

The above recited subject and other objects which will become apparent upon a reading of the following specification and claims are achieved by strumming with a pick comprised of a thin rounded piece preferably a circular disc of molded or die cut plastic or other suitable material, which has a series of radially outwardly projecting points or serrations formed about its rounded perimeter which are spaced so that a plurality of the points substantially simultaneously engage each string when the pick is strummed across the strings of the instrument.

When the several points engage each string substantially simultaneously when strummed with the pick, a bright chorus sound results.

This unique sound is obtained particularly when several strings are strummed.

An additional benefit of a circular shape is that it is completely symmetrical and need not be held in the fingers in any particular orientation when strumming the strings of the instrument.

DETAILED DESCRIPTION

Figure 3:
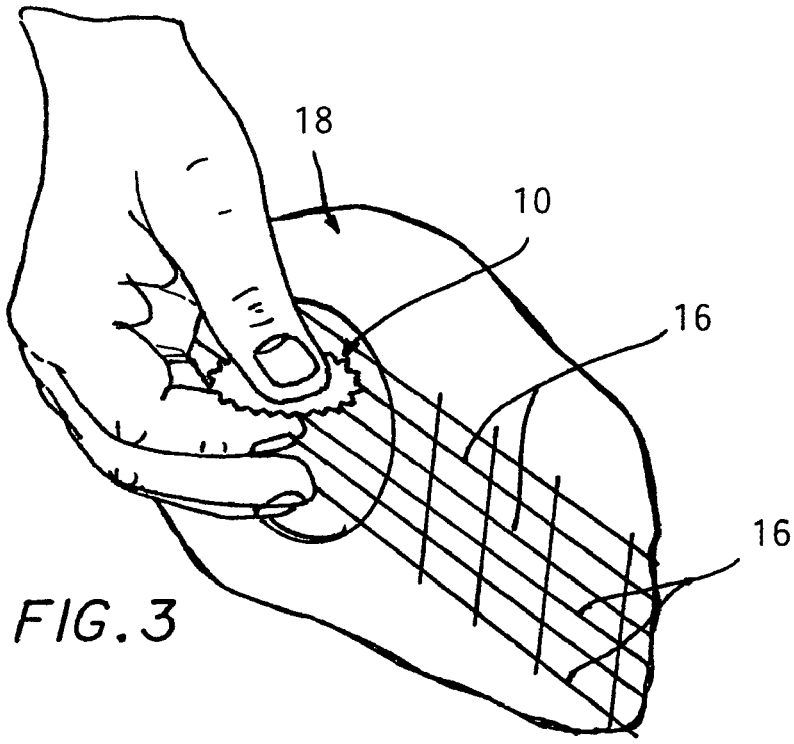
FIG. 3 is a pictorial view of the pick shown in FIGS. 1 and 2 being held in playing a guitar.
Figure 1:
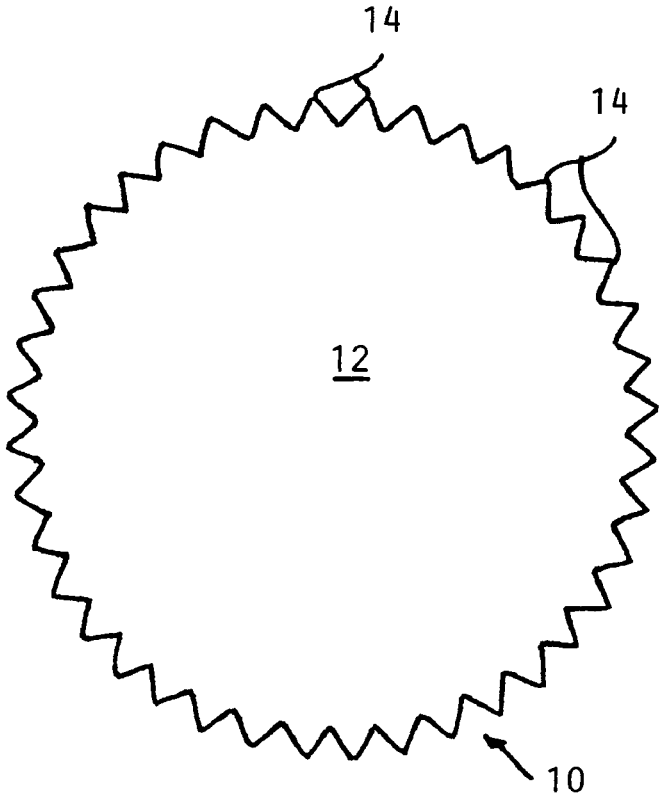
FIG. 1 is a plan enlarged view of a pick according to the present invention.
Figure 2:
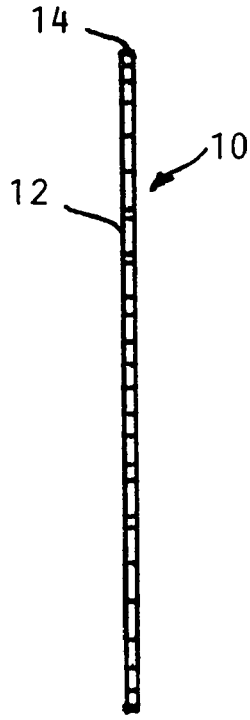
FIG. 2 is an on edge view of the pick shown in FIG. 1.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

A pick 10 according to the invention comprises a rounded piece, preferably a circular thin disc 12, made of durable plastic such as DELRIN™ or nylon which can be molded or die cut to have a series of serrations or points 40 projecting radially outward and extending around the entire perimeter of the disc 12 to form an outer serrated edge.

The exact diameter of the pick 10 is not critical, but a diameter of 1 3/16 inches has been found to effectively produce the enhanced sound while not interfering with strumming of the strings. The pick thickness can vary to provide a desired stiffness suited to an individual player's individual preference and technique, i.e., thin,/0.018 mm, medium, 0.028 mm and thick, 1.00 mm comprising a preferred range of thicknesses. Thickness ranges of 0.50 mm to 0.75 mm are also possible.

The picks of various thicknesses can be color coded for easy selection, i.e., red for thin, yellow for medium, and black for thick.

The points 40 are preferably uniform in size and evenly spaced to form a serrated outer edge.

The number, spacing, and height of the series of points 14 can also vary somewhat, as long as plurality of points will engage each string when strummed. However, points that are too small and too closely spaced have been found to diminish the effect, while points that are too large will create a tendency for the points to catch on the strings and pull the pick 10 out of the user's hand. A uniform series of 40 points 14 extending completely around the perimeter of a 1 3/16 inch diameter circular pick has been found to create the desired chorus sound to a maximum level, while not having an excessive tendency to catch on the strings.

The angle and height can be varied to achieve good wear resistance and minimal tendency to catch on a string, with a height of about 1/16 inches providing the effect while having good durability and playability in the embodiment described.

The bright chorus sound is believed to be created when several points 14 substantially simultaneously engage each string 16 on a guitar 18, particularly when several strings are strummed. This effect is particularly evident when such a pick is used to play a guitar.

As noted, each string 16 is plucked or strummed substantially simultaneously at closely spaced locations along the string by a plurality of the points 40, but at locations sufficiently for a part to create multiple soundings of the string.

This improvement is achieved without any need to hold the pick 10 in any particular orientation in the player's hand when the points 14 are symmetrically arranged around the entire perimeter of the pick 10 as seen in FIG. 3.

However, it has been found that a serrated edge pick 10 most effectively produces the brighter sound when held at a slight angle to the strings, as may be determined by the particular technique of the player.

The pick 10 may be made at low cost as by a molding or die cutting process while achieving a significantly enhanced instrument tone.

The invention claimed is:

1. A pick for strumming the strings of a musical instrument, said pick comprising a flat piece having a series of radially projecting points arranged along a perimeter thereof, said points sized so that a plurality of points engage a single string when strummed, said pick circular with a uniform series of said points extending completely around said perimeter thereof to form a serrated outer edge on said pick.

2. The pick according to claim 1 wherein said piece comprises a flat disc.

3. The pick according to claim 1 wherein said pick is plastic.

4. The pick according to claim 1 wherein said pick is approximately 1 3/16 inches in diameter.

5. The pick according to claim 4 wherein approximately 40 points are arranged around said perimeter.

6. The pick according to claim 5 wherein said pick is of plastic and is of a thickness of 100 mm or less.

7. The pick according to claim 5 wherein said points are approximately 1/16 inch in height.

8. A method of producing a chorus sound from a strummed stringed instrument comprising a guitar, said method including strumming said strings with a held pick comprised of a flat circular disc having a round perimeter thereof formed with a series of points about said perimeter sized and arranged so that a plurality of said points simultaneously engage each string when said strings are strummed with said perimeter of said pick.

9. The method according to claim 8 wherein said pick has a diameter of about 1 3/16 inches and is formed with a series of about 40 points arrayed completely around said perimeter to form a serrated outer edge providing said plurality of points which simultaneously engage each of said strings.

10. The method according to claim 8 wherein said pick is held at a slight angle to said strings when strumming said strings.

* * * * *